US008148919B2

(12) United States Patent
Liu et al.

(10) Patent No.: US 8,148,919 B2
(45) Date of Patent: Apr. 3, 2012

(54) CIRCUITS AND METHODS FOR DRIVING LIGHT SOURCES

(75) Inventors: Da Liu, Milpitas, CA (US); Yung Lin Lin, Palo Alto, CA (US)

(73) Assignee: O2Micro, Inc, Santa Clara, CA (US)

( * ) Notice: Subject to any disclaimer, the term of this patent is extended or adjusted under 35 U.S.C. 154(b) by 0 days.

(21) Appl. No.: 13/274,663

(22) Filed: Oct. 17, 2011

(65) Prior Publication Data

US 2012/0032613 A1 Feb. 9, 2012

Related U.S. Application Data

(63) Continuation-in-part of application No. 13/086,822, filed on Apr. 14, 2011, which is a continuation-in-part of application No. 12/221,648, filed on Aug. 5, 2008, now Pat. No. 7,919,936.

(60) Provisional application No. 61/374,117, filed on Aug. 16, 2010.

(51) Int. Cl.
*H05B 37/02* (2006.01)

(52) U.S. Cl. ..... 315/307; 315/219; 315/279; 315/308

(58) Field of Classification Search ..... 315/291, 315/307, 308, 219, 224, 276, 279, 209 R
See application file for complete search history.

(56) References Cited

U.S. PATENT DOCUMENTS 6,724,156 B2 4/2004 Fregoso et al.
7,276,861 B1 * 10/2007 Shteynberg et al. ..... 315/291
7,307,614 B2 12/2007 Vinn et al.
7,323,828 B2 * 1/2008 Russell et al. ..... 315/291
7,402,961 B2 7/2008 Bayat et al.
7,777,430 B2 8/2010 Catalano et al.
7,781,979 B2 8/2010 Lys
7,812,553 B2 10/2010 Kang et al.
7,847,486 B2 * 12/2010 Ng ..... 315/119
7,880,400 B2 2/2011 Zhou et al.
7,919,928 B2 * 4/2011 Ziegenfuss ..... 315/227 R

FOREIGN PATENT DOCUMENTS

CN 101155450 A 4/2008
CN 101222800 A 7/2008
TW 200738048 A 10/2007
TW M343351 U 10/2008

* cited by examiner

*Primary Examiner* — David Hung Vu

(57) ABSTRACT

A driving circuit for powering a light-emitting diode (LED) light source includes a converter circuit, an energy storage element and a switch element. The converter circuit provides a first output voltage on a first power line to provide power to the LED light source and provides a second output voltage on a second power line that is less than the first output voltage. The energy storage element is charged and discharged to regulate a current through the LED light source. The switch element operates in a first state during which the energy storage element is charged and operates in a second state during which the energy storage element is discharged. The converter circuit provides the second output voltage to maintain an operating voltage across the switch element less than the first output voltage during both the first state and the second state.

20 Claims, 10 Drawing Sheets

CIRCUITS AND METHODS FOR DRIVING LIGHT SOURCES

RELATED APPLICATION

This application is a continuation-in-part of the co-pending U.S. application Ser. No. 13/086,822, titled "Circuits and Methods for Powering Light Sources," filed on Apr. 14, 2011, which itself is a continuation-in-part of the co-pending U.S. application Ser. No. 12/221,648, titled "Driving Circuit for Powering Light Sources," filed on Aug. 5, 2008, now U.S. Pat. No. 7,919,936, which also claims priority to U.S. Provisional Application No. 61/374,117, titled "Circuits and Methods for Powering Light Sources," filed on Aug. 16, 2010, all of which are fully incorporated herein by reference.

BACKGROUND

In a display system, one or more light sources are driven by a driving circuit to illuminate a display panel. For example, in a liquid crystal display (LCD) system with light-emitting diode (LED) backlight, an LED array is used to illuminate an LCD panel. An LED array usually includes one or more LED strings, and each LED string includes a group of LEDs coupled in series.

FIG. 1 illustrates a block diagram of a conventional driving circuit 100. The driving circuit 100 is used to drive an LED string 106 and includes a converter circuit 102, a switch controller 104, and a switching regulator 108. The converter circuit 102 receives an input voltage $V_{IN}$ and provides an output voltage $V_{OUT}$ on a power line 141 to the LED string 106. The switching regulator 108 includes an inductor L1 coupled to the LED string 106 in series. The switching regulator 108 further includes a switch S1 and a diode D1 for controlling an inductor current flowing through the inductor L1. More specifically, the switch controller 104 provides a pulse-width modulation (PWM) signal 130 to turn the switch S1 on and off. When the switch S1 is turned on, the diode D1 is reverse-biased and the inductor current sequentially flows through the power line 141, the LED string 106, the inductor L1, the switch S1, and the resistor $R_{SEN}$. The output voltage $V_{OUT}$ powers the LED string 106 and charges the inductor L1. When the switch S1 is turned off, the diode D1 is forward-biased and the inductor current sequentially flows through the inductor L1, the diode D1, the power line 141, and the LED string 106. The inductor L1 is discharged to provide power to the LED string 106. As such, by adjusting a duty cycle of the PWM signal 130, an average level of the inductor current is regulated and thus the current through the LED string 106 is regulated.

However, when the switch S1 is off, the voltage at the anode of the diode D1, e.g., $V_{ANODE}$, is increased to be greater than $V_{OUT}$ to forward bias the diode D1. Then, the voltage across the switch S1, e.g., $V_{ANODE}-V_R$, is approximately equal to $V_{OUT}$. When the switch S1 is on, the voltage across the diode D1 is approximately equal to $V_{OUT}$. Therefore, the voltage ratings of switching elements such as the switch S1 and the diode D1 have to be greater than $V_{OUT}$. Otherwise, the switching elements can be damaged when the operating voltages are approximately equal to $V_{OUT}$. When the number of LEDs in the LED string 106 is increased to achieve a higher brightness, the output voltage $V_{OUT}$ is increased. As such, the switching elements with relatively high voltage ratings increase the power consumption and the cost of the driving circuit 100.

SUMMARY

In one embodiment, a driving circuit for powering a light-emitting diode (LED) light source includes a converter circuit, an energy storage element and a switch element. The converter circuit provides a first output voltage on a first power line to provide power to the LED light source and provides a second output voltage on a second power line that is less than the first output voltage. The energy storage element is charged and discharged to regulate a current through the LED light source. The switch element operates in a first state during which the energy storage element is charged and operates in a second state during which the energy storage element is discharged. The converter circuit provides the second output voltage to maintain an operating voltage across the switch element less than the first output voltage during both the first state and the second state.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments in accordance with the present invention provide a driving circuit for powering a load. For illustration purposes, the invention is described in relation to powering a light source such as a light-emitting diode string. However, the invention is not limited to powering a light source and can be used to power other types of load. The driving circuit includes a converter circuit, an energy storage element and a switch element. The converter circuit provides a first output voltage on a first power line to drive the light source and provides a second output voltage on a second power line that is less than the first output voltage. The switch element operates in a first state during which the energy storage element is charged and operates in a second state during which the energy storage element is discharged. By adjusting time durations of the first state and the second state, a current through the light source is regulated.

Advantageously, due to the second output voltage on the second power line, an operating voltage across the switch element is maintained less than the first output voltage during both the first and second states. Thus, voltage ratings of the switch element can be decreased to reduce the power consumption and the cost of the driving circuit.

Figure 2:
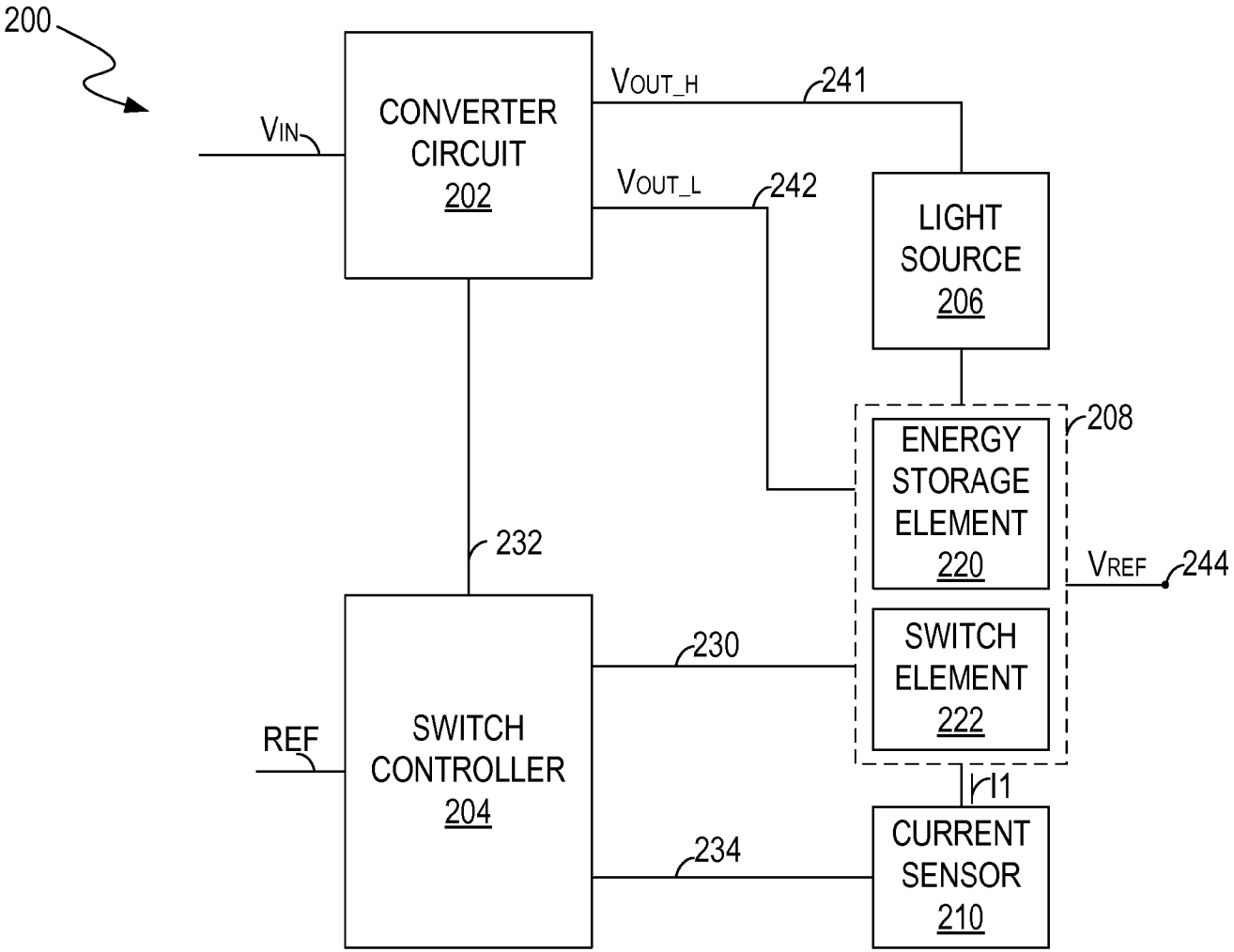
FIG. 2 illustrates a block diagram of a driving circuit for driving a load, in accordance with one embodiment of the present invention.

FIG. 2 illustrates a block diagram of a driving circuit 200 for driving a load, e.g., a light source 206, in accordance with one embodiment of the present invention. The driving circuit 200 includes a converter circuit 202, a switch controller 204, a switching regulator 208, and a current sensor 210. The converter circuit 202 receives an input voltage $V_{IN}$, generates an output voltage $V_{OUT_H}$ on a power line 241, and generates an output voltage $V_{OUT_L}$ on a power line 242 that is less than $V_{OUT_H}$. The voltage $V_{OUT_H}$ is used to drive the light source 206. The voltage $V_{OUT_L}$ is used to reduce operating voltages of one or more switch elements in the switching regulator 208.

The current sensor 210 coupled to the light source 206 generates a sense signal 234 indicative of a current through the light source 206. In one embodiment, the switch controller 204 generates a switch control signal 230 and a feedback signal 232 based on the sense signal 234. In one embodiment, the switch controller 204 compares the sense signal 234 to a reference signal REF indicative of a desired current level, and generates the switch control signal 230 based on a result of the comparison. As such, the switch control signal 230 controls the switching regulator 208 so as to adjust the current through the light source 206 to the desired current level. The feedback signal 232 indicates a forward voltage needed by the light source 206 to produce a current having the desired current level. Thus, upon receiving the feedback signal 232, the converter circuit 202 adjusts the output voltage $V_{OUT_H}$ to satisfy the power need of the light source 206.

In one embodiment, the light source 206 includes one or more light-emitting diode (LED) strings. Each LED string includes one or more LEDs coupled in series. In one embodiment, the switching regulator 208 includes an energy storage element 220 and a switch element 222. The energy storage element 220 is coupled to the light source 206, and a current $I_{220}$ flowing through the energy storage element 220 determines the current through the light source 206.

In one embodiment, the switch element 222 is coupled to the power line 241, the power line 242, and a reference node 244 having a reference voltage $V_{REF}$, e.g., 0 volt if coupled to ground. The switch element 222 is controlled by the switch control signal 230 to operate in multiple operation states. During different operation states, the switch element 222 selectively couples the power line 241, the power line 242, and the reference node 244 to terminals of the energy storage element 220 so as to conduct different current paths for the current $I_{220}$ of the energy storage element 220.

More specifically, the operation states of the switch element 222 include a switch-on state and a switch-off state. During the switch-on state, the switch element 222 conducts the current $I_{220}$ through two of the power line 241, the power line 242, and a reference node 244. The operating voltage $V_{220}$ has a first level to increase the current $I_{220}$ and the energy storage element 220 is charged. During the switch-off state, the switch element 222 conducts the current $I_{220}$ through another two of the power line 241, the power line 242, and a reference node 244. The operating voltage $V_{220}$ has a second level to decrease the current $I_{220}$ and the energy storage element 220 is discharged. Therefore, by adjusting a ratio of the switch-on state duration to the switch-off state duration, the current though the light source 206 (e.g., an average current of the current $I_{220}$) is regulated. The operation of switching regulator 208 is further described in relation to FIG. 3, FIG. 6 and FIG. 7.

Figure 1:
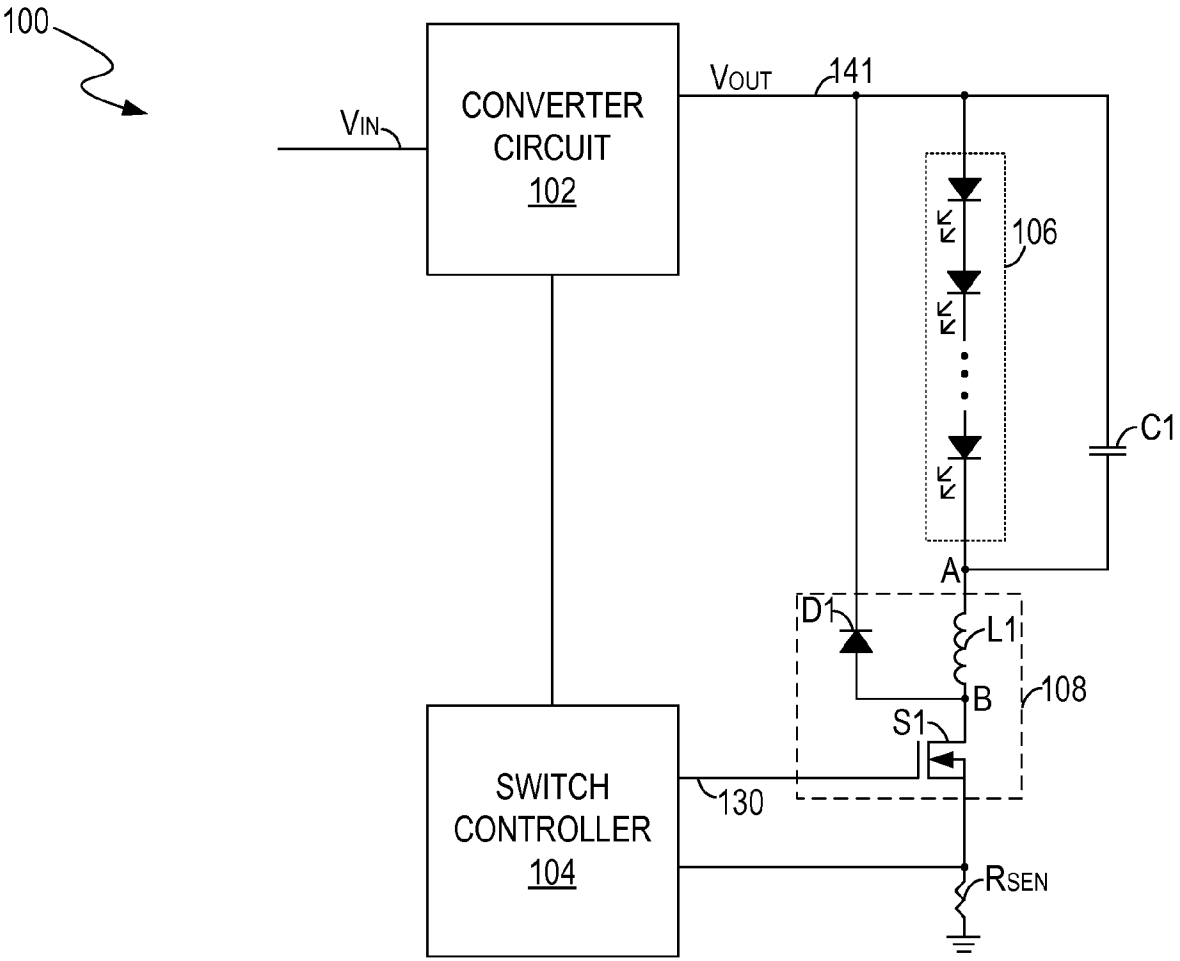
FIG. 1 (PRIOR ART)
FIG. 1 illustrates a block diagram of a conventional driving circuit.
Figure 3:
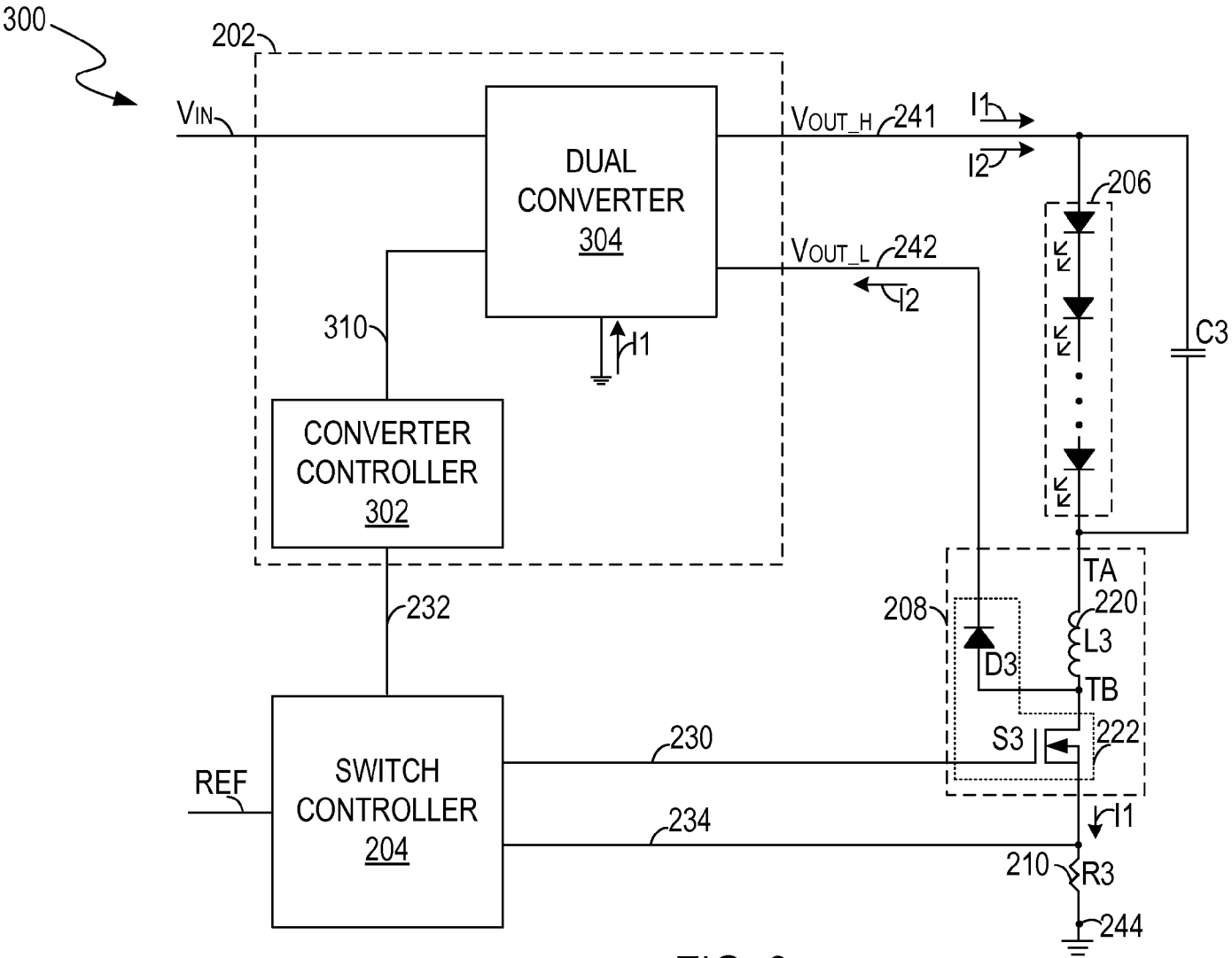
FIG. 3 illustrates another diagram of a driving circuit for driving a load, in accordance with one embodiment of the present invention.
Figure 6:
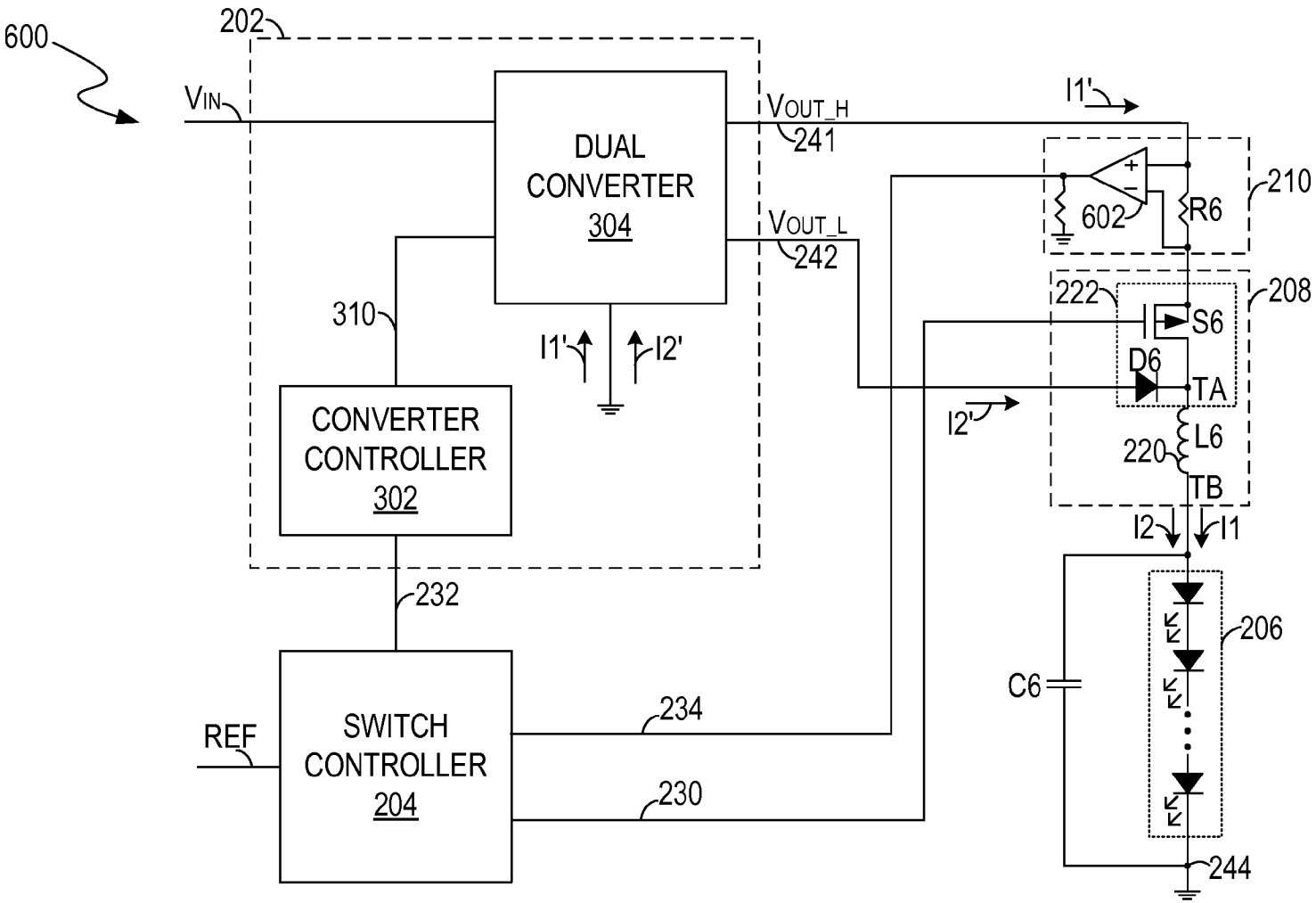
FIG. 6 illustrates another diagram of a driving circuit for driving a load, in accordance with one embodiment of the present invention.
Figure 7:
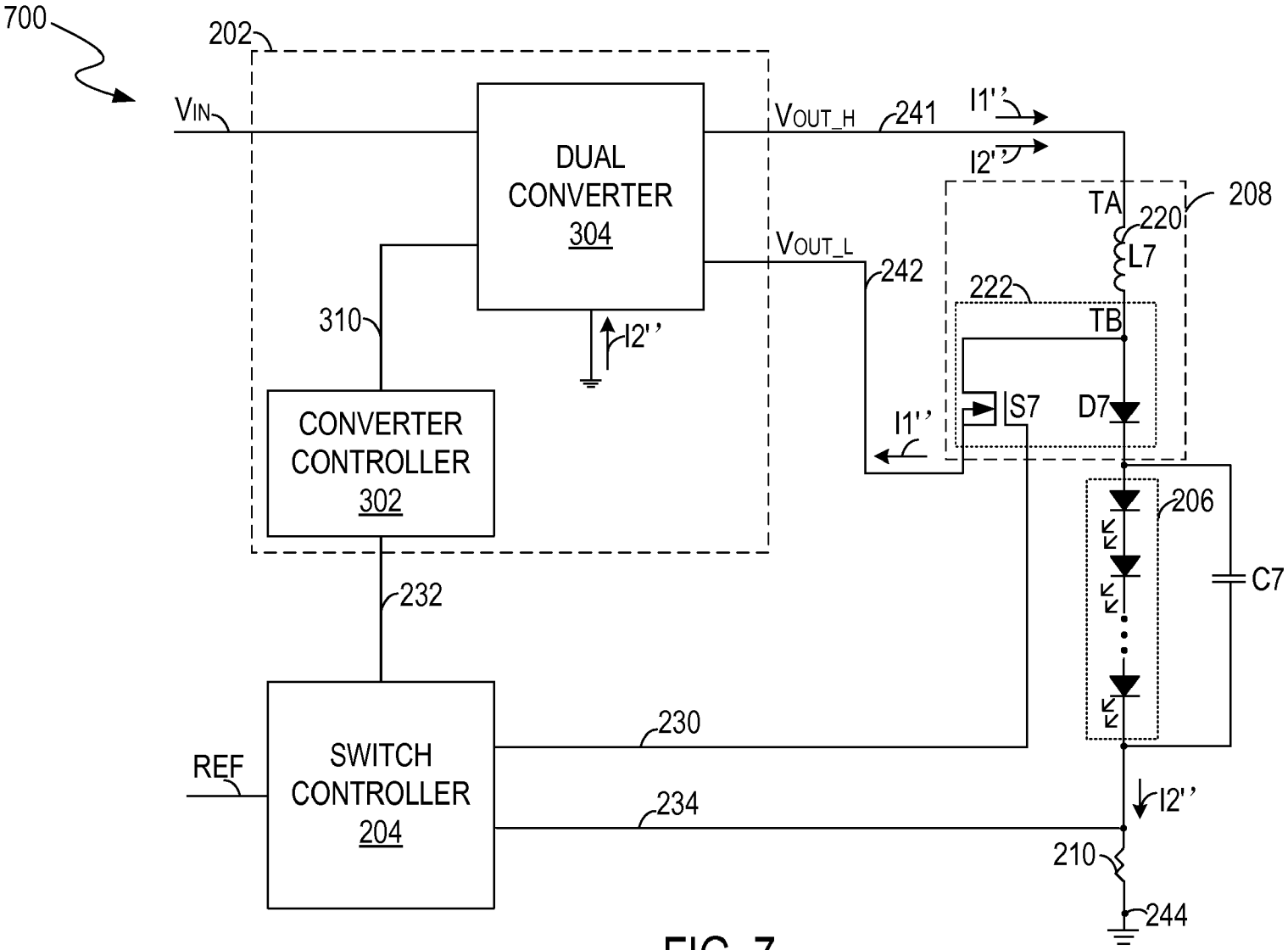
FIG. 7 illustrates another diagram of a driving circuit for driving a load, in accordance with one embodiment of the present invention.

Advantageously, as is further described in relation to FIG. 3, FIG. 6 and FIG. 7, due to the voltage $V_{OUT_L}$ on the power line 242, the operating voltage across the switch element 222 is maintained less than $V_{OUT_H}$ during both the switch-on state and the switch-off state. Thus, the voltage ratings of the switch element 222 are decreased compared to those of the switch S1 and the diode D1 in the conventional driving circuit 100 of FIG. 1. Therefore, the power consumption and the cost of the driving circuit 200 are both reduced.

FIG. 3 illustrates a diagram of a driving circuit 300 for driving a load, e.g., the light source 206, in accordance with one embodiment of the present invention. Elements labeled the same as in FIG. 2 have similar functions. FIG. 3 is described in combination with FIG. 2.

In the example of FIG. 3, the light source 206 includes an LED string having multiple LEDs coupled in series. The driving circuit 300 includes a converter circuit 202, a switch controller 204, a switching regulator 208, and a current sensor 210. The current sensor 210 includes a resistor R3 for generating the sense signal 234 indicating an LED current flowing through the LED string 206. In one embodiment, the sense signal 234 is a voltage across the resistor R3. Based on the sense signal 234, the switch controller 204 generates the switch control signal 230, e.g., a pulse-width modulation (PWM) signal, and the feedback signal 232.

The converter circuit 202 includes a converter controller 302 and a dual converter 304, in one embodiment. The converter controller 302 receives the feedback signal 232 indicating the forward voltage required by the LED string 206 to produce the desired current, and generates the control signal 310 accordingly. The dual converter 304 receives an input voltage $V_{IN}$, and generates output voltages $V_{OUT_H}$ and $V_{OUT_L}$ according to the control signal 310. For example, according to the feedback signal 232, the converter controller 302 adjusts the control signal 310 to increase or decrease the output voltage $V_{OUT_H}$ to regulate the LED current to the desired current level.

In one embodiment, the dual converter 304 receives the input voltage $V_{IN}$, and generates the output voltage $V_{OUT_L}$ and the output voltage $V_{OUT_H}$ that is equal to the output voltage $V_{OUT_L}$ plus a voltage $V_{DIFF}$. Thus, $$V_{OUT_H}=V_{OUT_L}+V_{DIFF}. \quad (1)$$

As shown in equation (1), $V_{OUT_L}$ is less than $V_{OUT_H}$ if $V_{DIFF}$ has a positive level. The operation of the dual converter 304 is further described in relation to FIG. 4A, FIG. 4B and FIG. 5.

The switching regulator 208 is operable for regulating the current flowing through the LED string 206. In the embodiment of FIG. 3, the switching regulator 208 has a buck configuration. The energy storage element 220 of the switching regulator 208 includes an inductor L3 coupled to the LED string 206. The switch element 222 of the switching regulator 208 includes a switch S3 and a diode D3. For example, the switch S3 can be an N type metal-oxide semiconductor (MOS) transistor. The anode of the diode D3 and the drain of the switch S3 are coupled together to a common node which is coupled to the power line 241 through the inductor L3 and the LED string 206. The cathode of the diode D3 is coupled to the power line 242. The source of the switch S3 is coupled to ground through the resistor R3.

The switch element 222 selectively couples ground, the power line 241 and the power line 242 to the inductor L3 according to the switch control signal 230. More specifically, the switch control signal 230 can be a pulse-width modulation (PWM) signal. When the switch control signal 230 is logic high, the switch element 222 operates in a switch-on state, in which the switch S3 is on and the diode D3 is reverse-biased. As such, a terminal TA of the inductor L3 is electrically coupled to the power line 241 and the other terminal TB of the inductor L3 is electrically coupled to ground. Thus, a current I1 flows through the power line 241, the LED string 206, the inductor L3, the resistor R3, and ground, and then flows from ground through the dual converter 304 to the power line 241. The operating voltage of the inductor L3 has a first level. The inductor L3 is charged and its current increases.

When the switch control signal 230 is logic low, the switch element 222 operates in a switch-off state, in which the switch S3 is off and the diode D3 is forward-biased. The terminal TA is electrically coupled to the power line 241 and the terminal TB is electrically coupled to the power line 242. Thus, a current I2 flows through the power line 241, the LED string 206, the inductor L3, the diode D3, and the power line 242, and then flows from the power line 242 through the dual converter 304 to the power line 241. The operating voltage of the inductor L3 has a second level determined by the voltage $V_{OUT_H}$ and the voltage $V_{OUT_L}$. The inductor L3 is discharged and its current decreases.

Accordingly, in one embodiment, the inductor current is increased when the switch control signal 230 is logic high and is decreased when the switch control signal 230 is logic low. In the example of FIG. 3, the current through the LED light source 206 is substantially equal to the average current though the inductor L3. Consequently, by controlling a duty cycle of the switch control signal 230, the switch controller 204 can regulate the current through the LED light source 206 to a desired current level.

Advantageously, during the switch-on state of the switch element 222, the voltage $V_{D3}$ across the diode D3 is less than $V_{OUT_H}$, e.g., $V_{D3}$ is approximately equal to $V_{OUT_L}$. During the switch-off state of the switch element 222, the voltage $V_{s3}$ across the switch S3 is also less than $V_{OUT_H}$. That is, by utilizing the output voltage $V_{OUT_L}$ from the dual converter 304, an operating voltage across each of the switch S3 and the diode D3 is maintained less than $V_{OUT_H}$ during both the switch-on and switch-off states. Thus, the voltage ratings of such components can be decreased to reduce the power consumption and the cost of the driving circuit 300.

Figure 4A:
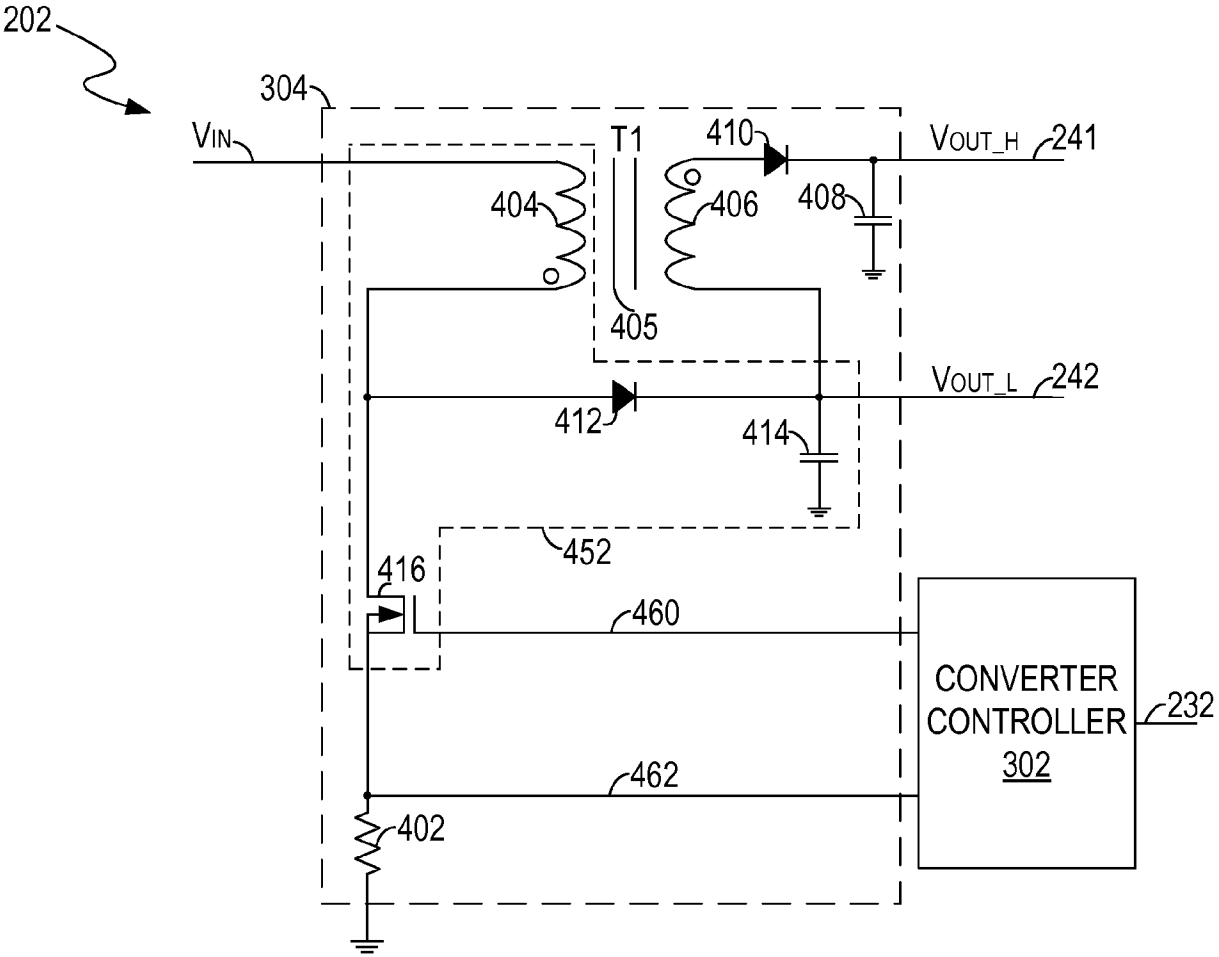
FIG. 4A and FIG. 4B illustrate an example of a converter circuit, in accordance with one embodiment of the present invention.
Figure 4B:
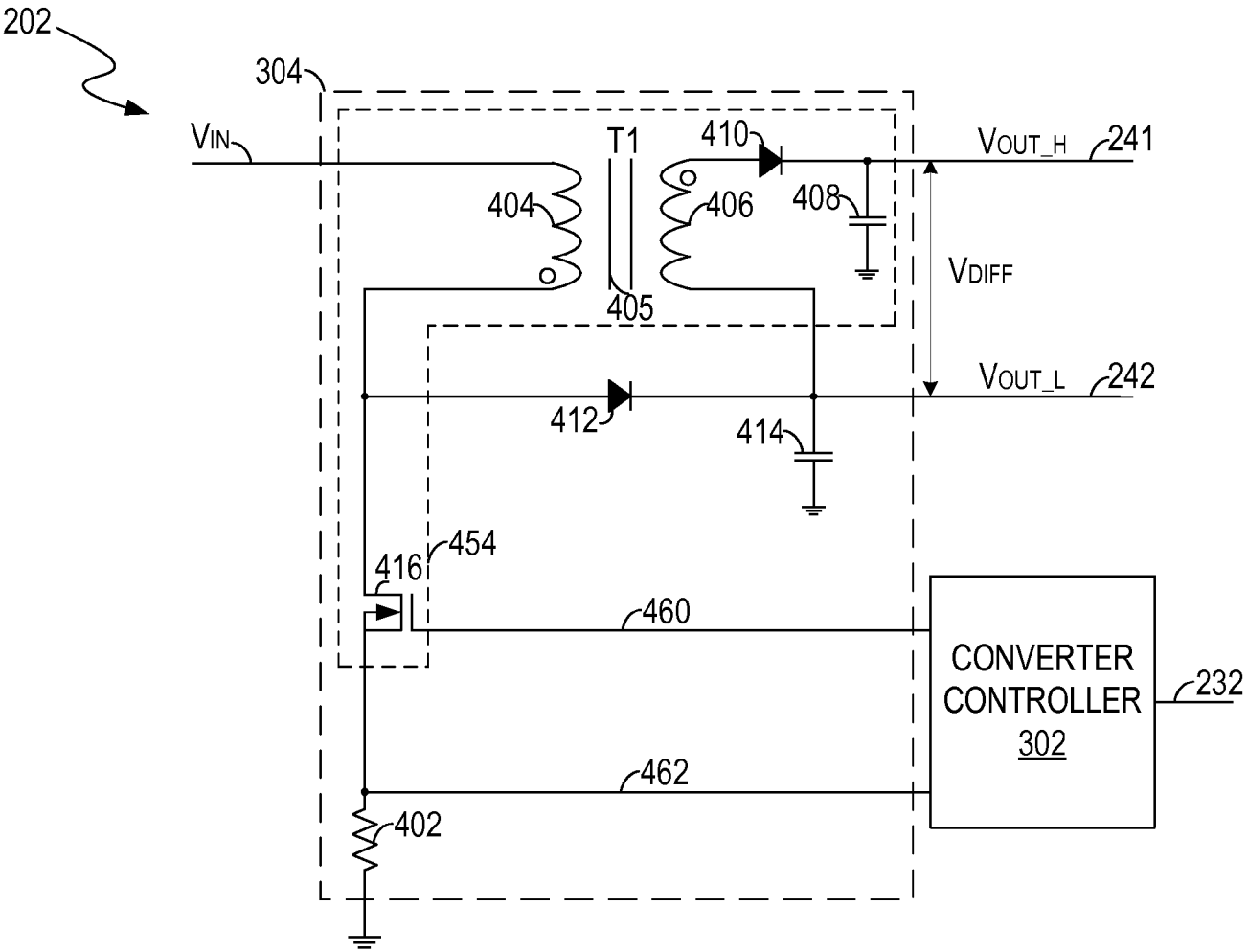

FIG. 4A and FIG. 4B illustrate an example of the converter circuit 202, in accordance with one embodiment of the present invention. Elements labeled the same as in FIG. 2 and FIG. 3 have similar functions. FIG. 4A and FIG. 4B are described in combination with FIG. 2 and FIG. 3.

In the example of FIG. 4A and FIG. 4B, the dual converter 304 includes a resistor 402, a switch 416, a transformer T1, diodes 410 and 412, and capacitors 408 and 414. The transformer T1 includes a primary winding 404, a core 405, and a secondary winding 406. The dual converter 304 generates an output voltage $V_{OUT_L}$ and a voltage $V_{DIFF}$. More specifically, as shown in FIG. 4A, the primary winding 404 of the transformer T1, the diode 412, the capacitor 414 and the switch 416 constitute a switch-mode boost converter 452. The converter controller 302 generates a drive signal 460 to control the switch 416. In one embodiment, the drive signal 460 is a PWM signal having a duty cycle $D_{DUTY}$, which alternately turns the switch 416 on and off. As such, the switch-mode boost converter 452 converts the input voltage $V_{IN}$ to the output voltage $V_{OUT_L}$. If the resistance of the resistor 402 is ignored, the output voltage $V_{OUT_L}$ on the power line 242 is calculated according to:

$$V_{OUT_L}=V_{IN}/(1-D_{DUTY}). \quad (2)$$

Furthermore, as shown in FIG. 4B, the transformer T1 (e.g., T1 including the primary winding 404, the core 405 and the secondary winding 406), the diode 410, the capacitor 408 and the switch 416 constitute a switch-mode flyback converter 454. By alternately turning the switch 416 on and off according to the drive signal 460, the flyback converter 454 converts the input voltage $V_{IN}$ to the voltage $V_{DIFF}$. The voltage $V_{DIFF}$ is obtained according to:

$$V_{DIFF}=V_{IN}*(N_{406}/N_{404})*D_{DUTY}/(1-D_{DUTY}), \quad (3)$$

where $N_{406}/N_{404}$ represents a turn ratio of the secondary winding 406 to the primary winding 404.

In one embodiment, since the non-polarity end of the secondary winding 406 is coupled to the power line 242, the output voltage $V_{OUT_H}$ is equal to the output voltage $V_{OUT_L}$ plus the voltage $V_{DIFF}$, as shown in equation (1). Thus, based on equations (1), (2) and (3), $$V_{OUT_H}=V_{OUT_L}*(1+D_{DUTY}*(N_{406}/N_{404})) \quad (4)$$

As shown in equation (4), $V_{OUT_H}$ is greater than $V_{OUT_L}$ as long as the duty cycle $D_{DUTY}$ is greater than zero. Moreover, according to equations (2) and (4), by adjusting the duty cycle $D_{DU}$ of the drive signal 460, both $V_{OUT_H}$ and $V_{OUT_L}$ are adjusted accordingly.

Advantageously, the boost converter 452 shown in FIG. 4A and the flyback converter 454 shown in FIG. 4B have common components such as the primary winding 404 and the switch 416, which reduces the component count. Thus, the size of the converter circuit 304 is decreased and the cost of the driving circuit 200 is reduced.

The resistor 402 provides a current monitoring signal 462 indicative of a current flowing through the primary winding 404. The converter controller 302 receives the current monitoring signal 462 and determines whether the converter circuit 304 undergoes an abnormal or undesired condition, e.g., an over-current condition. The converter controller 302 controls the converter circuit 304 to prevent the abnormal or undesired condition. For example, the converter controller 302 turns off the switch 416 via the drive signal 460 if the current monitoring signal 462 indicates that the converter circuit 304 undergoes an over-current condition.

Figure 5:
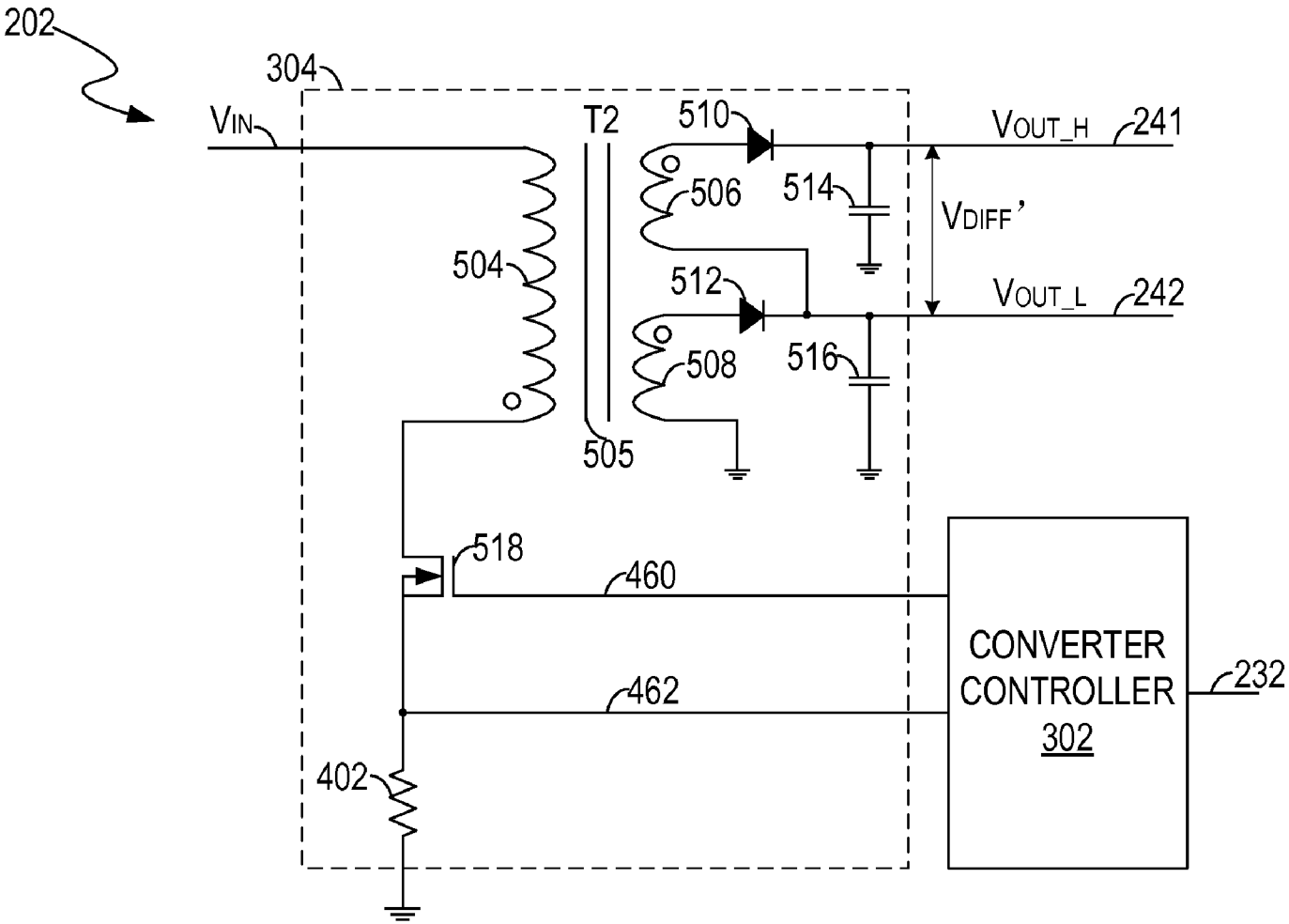
FIG. 5 illustrates another example of a converter circuit, in accordance with one embodiment of the present invention.

FIG. 5 illustrates another example of the converter circuit 202, in accordance with one embodiment of the present invention. Elements labeled the same as in FIG. 2-FIG. 4 have similar functions. FIG. 5 is described in combination with FIG. 2 and FIG. 3.

In the example of FIG. 5, the dual converter 304 includes a transformer T2, diodes 510 and 512, capacitors 514 and 516, a switch 518, and the resistor 402. The transformer T2 has a primary winding 504, a core 505, a secondary winding 506, and an auxiliary winding 508. The converter controller 232 generates the drive signal 460, e.g., a PWM signal, to turn the switch 518 on and off alternately. The primary winding 504, the core 505, the secondary winding 506, the switch 518, the diode 510 and the capacitor 514 constitute a first flyback converter. The first flyback converter converts the input voltage $V_{IN}$ to the voltage $V_{DIFF}'$. The voltage $V_{DIFF}'$ is represented as:

$$V_{DIFF}'=V_{IN}*(N_{506}/N_{504})*D_{DUTY}/(1-D_{DUTY}), \quad (5)$$

where $N_{506}/N_{504}$ represents a turns ratio of the secondary winding 506 and the primary winding 504.

Similarly, the primary winding 504, the core 505, the auxiliary winding 508, the switch 518, the diode 512 and the capacitor 516 constitute a second flyback converter. The second flyback converter converts the input voltage $V_{IN}$ to the voltage $V_{OUT_L}$. The voltage $V_{OUT_L}$ is represented as:

$$V_{OUT_L}=V_{IN}*(N_{508}/N_{504})*D_{DUTY}/(1-D_{DUTY}), \quad (6)$$

where $N_{508}/N_{504}$ represents a turns ratio of the auxiliary winding 508 and the primary winding 504.

As the non-polarity end of the secondary winding 506 is coupled to the power line 242, the voltage $V_{OUT_H}$ is equal to the voltage $V_{OUT_L}$ plus the voltage $V_{DIFF}$ according to equation (1). Based on equations (1), (5) and (6), the output voltage $V_{OUT_H}$ is calculated according to:

$$V_{OUT_H}=V_{OUT_L}*(1+N_{506}/N_{508}) \quad (7)$$

As shown in equation (7), $V_{OUT_H}$ is greater than $V_{OUT_L}$. As shown in equations (6) and (7), both $V_{OUT_H}$ and $V_{OUT_L}$ are adjusted according to the duty cycle $D_{DUTY}$ of the drive signal 460.

Advantageously, the first and second flyback converters share some common components, which decrease the size of the converter circuit 304 and reduce the cost of the driving circuit 200.

As discussed in relation to FIG. 3, during the switch-on state of the switch element 222 (e.g., when the switch S3 is on), the current I1 flows from ground through the dual converter 304 to the power line 241. During the switch-off state of the switch element 222 (e.g., when the switch S3 is off), the current I2 flows from the power line 242 through the dual converter 304 to the power line 241. If using the dual converter 304 as shown in FIG. 4A and FIG. 4B, during the switch-on state, the secondary winding 406 transfers the current I1 from ground through the capacitor 414 to the power line 241. During the switch-off state, the secondary winding 406 transfers the current I2 from the power line 242 to the power line 241. If using the dual converter 304 as shown in FIG. 5, during the switch-on state, the secondary winding 506 transfers the current I1 from ground through the capacitor 516 to the power line 241. During the switch-off state, the secondary winding 506 transfers the current I2 from the power line 242 to the power line 241. The dual converter 304 can include other configurations and is not limited to the examples shown in FIG. 4A, FIG. 4B, and FIG. 5.

FIG. 6 illustrates a diagram of a driving circuit 600 for driving a load, e.g., the LED string 206, in accordance with another embodiment of the present invention. Elements labeled the same as in FIG. 2 and FIG. 3 have similar functions. FIG. 6 is described in combination with FIG. 2-FIG. 5.

In the example of FIG. 6, the current sensor 210 includes a resistor R6 and an error amplifier 602. The error amplifier 602 receives a voltage across the resistor R6 and generates the sense signal 234 indicative of a current through the LED string 206 accordingly. In one embodiment, the switching regulator 208 coupled between the current sensor 210 and the LED string 206 has a buck configuration. The switching regulator 208 includes a switch element 222 and an energy storage element 220. In one embodiment, the energy storage element 220 includes an inductor L6 coupled to the LED string 206. The switch element 222 includes a switch S6 and a diode D6. In one embodiment, the switch S6 can be a P type MOS transistor. The anode of the diode D6 is coupled to the power line 242. The cathode of the diode D6 and the drain of the switch S6 are coupled together to a common node which is coupled to the ground through the inductor L6 and the LED string 206. The source of the switch S6 is coupled to the power line 241 through the current sensor 210.

The switch element 222 selectively couples the ground, the power line 241 and the power line 242 to the inductor L6 according to the switch control signal 230, e.g., a PWM signal. More specifically, when the switch control signal 230 is logic low, the switch element 222 operates in a switch-on state, in which the switch S6 is on and the diode D6 is reverse-biased. As such, the power line 241 and the ground are electrically coupled to terminals of the inductor L3. A current I1' flows through the power line 241, the resistor R6, the switch S6, the inductor L6, the LED string 206, and ground, and then flows from ground through the dual converter 304 to the power line 241. As the inductor current flows from the terminal TA to the terminal TB, the output voltage $V_{OUT_H}$ charges the inductor L6 and thus the inductor current I1' is increased.

Furthermore, when the switch control signal 230 is logic high, the switch element 222 operates in a switch-off state, in which the switch S6 is off and the diode D6 is forward-biased. As such, the power line 242 and the ground are electrically coupled to the terminals of the inductor L6. A current I2' flows through the power line 242, the diode D6, the inductor L6, the LED string 206, and ground, and then flows from ground through the dual converter 304 to the power line 242. The inductor L6 is discharged to power the LED string 206 and the inductor current, e.g., I2', flowing from the terminal TA to the terminal TB is gradually decreased. Similar to the driving circuit 300 in FIG. 3, the switch controller 204 can adjust the LED current to a desired current level by adjusting the duty cycle of the switch control signal 230.

Advantageously, during the switch-on state, the voltage $V_{D6}$ across the diode D6 is less than $V_{OUT_L}$. During the switch-off state, the voltage across the switch S6 is approximately equal to $V_{OUT_H}$ minus $V_{OUT_L}$. That is, by utilizing the voltage $V_{OUT_L}$, an operating voltage across each of the switch S6 and the diode D6 is maintained less than $V_{OUT_H}$ during both the switch-on and switch-off states. As such, the voltage ratings of the switch S6 and the diode D6 can be decreased to reduce the power consumption and the cost of the driving circuit 600.

The dual converter 304 in the example of FIG. 4A, FIG. 4B, and FIG. 5 can also be used in the driving circuit 600. If employing the dual converter 304 in FIG. 4A and FIG. 4B, during the switch-on state, the secondary winding 406 transfers the current I1' from ground through the capacitor 414 to the power line 241. During the switch-off state, the current I2' flows from ground through the capacitor 414 to the power line 242. If employing the dual converter 304 in FIG. 5, during the switch-on state, the secondary winding 506 transfers the current I1' from ground through the capacitor 516 to the power line 241. During the switch-off state, the current I2' flows from ground through the capacitor 516 to the power line 242.

FIG. 7 illustrates a diagram of a driving circuit 700 for driving a load, e.g., the LED string 206, in accordance with another embodiment of the present invention. Elements labeled the same as in FIG. 2 and FIG. 3 have similar functions. FIG. 7 is described in combination with FIG. 2-FIG. 5.

In the example of FIG. 7, the switching regulator 208 coupled to the LED string 206 has a boost configuration. The storage element 220 includes an inductor L7 coupled to the power line 241. The switch element 222 includes a switch S7 and a diode D7. In one embodiment, the switch S7 can be an N type MOS transistor. The anode of the diode D7 and the drain of the switch S7 are coupled together to a common node which is coupled to the power line 241 through the inductor L7. The source of the switch S7 is coupled to the power line 242. The cathode of the diode D7 is coupled to the ground through the LED string 206 and the sensor 210.

The switch element 222 selectively couples the ground, the power line 241 and the power line 242 to the inductor L7 according to the switch control signal 230, e.g., a PWM signal. More specifically, when the switch control signal 230 is logic high, the switch element 222 operates in a switch-on state, in which the switch S7 is on and the diode D7 is reverse-biased. As such, the power line 241 and the power line 242 are electrically coupled to terminals of the inductor L7. A current I1" flows through the power line 241, the inductor L7, the switch S7 and the power line 242, and then flows from the power line 242 through the dual converter 304 to the power line 241. The inductor current flows from the terminal TA to the terminal TB. The inductor L7 is charged and the current I1" is increased. Since the diode L7 is reverse-biased, the capacitor C7 powers the LED string 206.

Furthermore, when the switch control signal 230 is logic low, the switch element 222 operates in a switch-off state, in which the switch S7 is off and the diode D7 is forward-biased. As such, the power line 241 and the ground are electrically coupled to the terminals of the inductor L7. A current I2" flows through the power line 241, the inductor L7, the diode D7, the LED string 206, and ground, and then flows from ground through the dual converter 304 to the power line 241. The inductor current flows from the terminal TA to the terminal TB. The current I2" decreases and the inductor L7 is discharged to power the LED string 206 and to charge the capacitor C7. As such, the switch controller 204 regulates the LED current by adjusting the duty cycle of the switch control signal 230.

Advantageously, during the switch-on state, the voltage $V_{D7}$ across the diode D7 is less than $V_{OUT_H}$. During the switch-off state, the voltage across the switch S7 is less than $V_{OUT_H}$. That is, by utilizing the voltage $V_{OUT_L}$, an operating voltage across each of the switch S7 and the diode D7 is maintained less than $V_{OUT_H}$ during both the switch-on and switch-off states. Therefore, voltage ratings of the switch S7 and the diode D7 are less than $V_{OUT_H}$ to reduce the power consumption and the cost of the driving circuit 700.

The dual converter 304 in the example of FIG. 4A, FIG. 4B, and FIG. 5 can also be used in the driving circuit 700. If employing the dual converter 304 in FIG. 4A and FIG. 4B, during the switch-on state, the secondary winding 406 transfers the current I1" from the power line 242 through the capacitor 414 to the power line 241. During the switch-off state, the current I2" flows from ground through the capacitor 414 to the power line 241. If employing the dual converter 304 in FIG. 5, during the switch-on state, the secondary winding 506 transfers the current I1" from the power line 242 through the capacitor 516 to the power line 241. During the switch-off state, the current I2" flows from ground through the capacitor 516 to the power line 241. The switching regulator 208 can have other configurations as long as the configurations are within the scope of the claims, and is not limited to the buck configuration in FIG. 3 and FIG. 6 and the boost configuration in FIG. 7.

Figure 8:
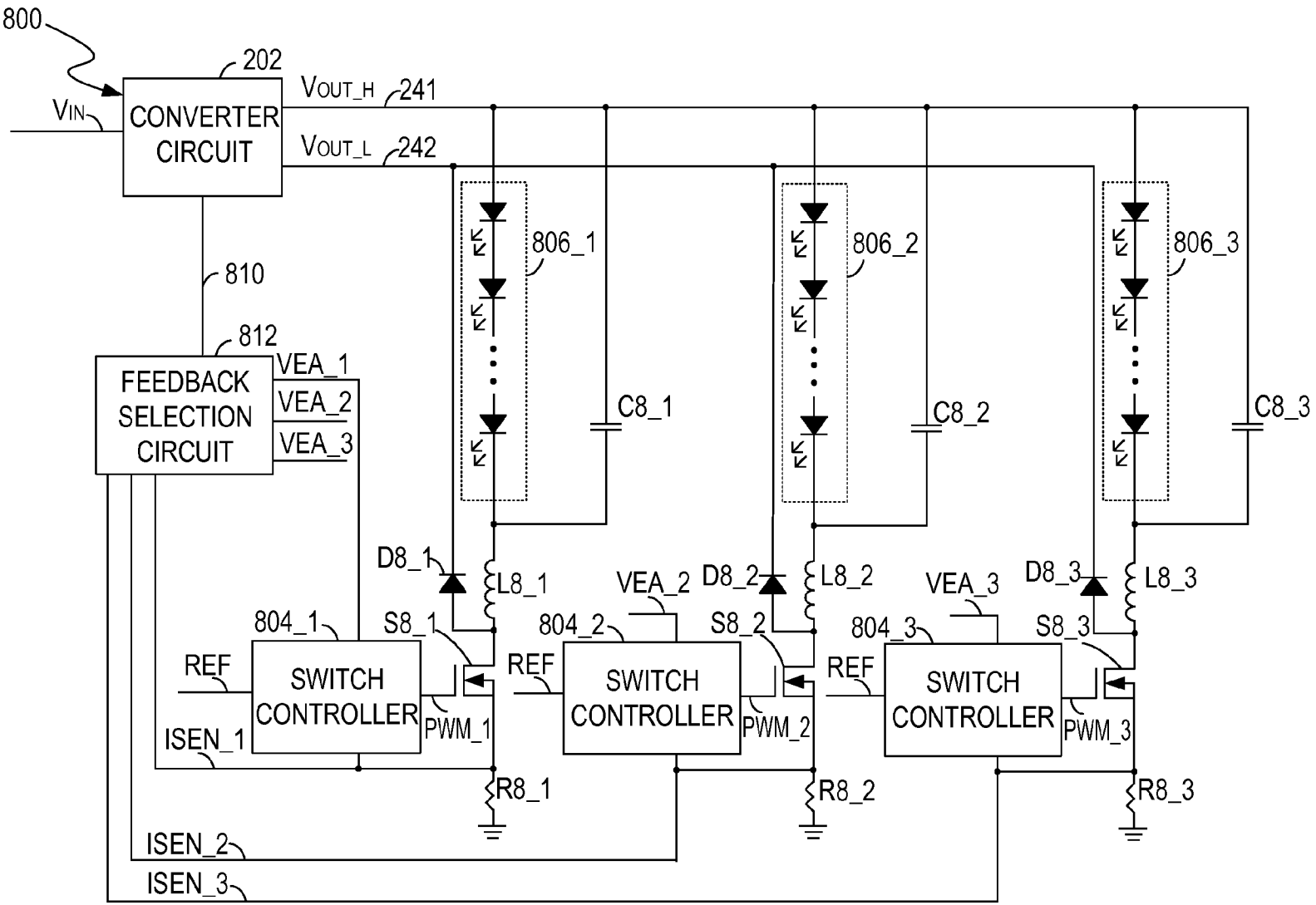
FIG. 8 illustrates a diagram of a driving circuit for driving multiple loads, in accordance with one embodiment of the present invention.

FIG. 8 illustrates a diagram of a driving circuit 800, in accordance with one embodiment of the present invention. Elements labeled the same as in FIG. 2 have similar functions. FIG. 8 is described in combination with FIG. 2, FIG. 3, FIG. 6 and FIG. 7.

The driving circuit 800 includes a converter circuit 202 operable for generating the output voltage $V_{OUT_H}$ on the power line 241 and the output voltage $V_{OUT_L}$ on the power line 242. In the example of FIG. 8, the driving circuit 800 is used to drive more than one LED strings. Although three LED strings 806_1, 806_2 and 806_3 are shown in the example of FIG. 8, other number of LED strings can be included in the driving circuit 800. Each LED string 806_1-806_3 is coupled to a circuit similar to the driving circuit 300 in FIG. 3. For example, the LED string 806_1 is coupled to a switching regulator including the diode D8_1, the switch S8_1 and the inductor L8_1; the LED string 806_2 is coupled to a switching regulator including the diode D8_2, the switch S8_2 and the inductor L8_2; and the LED string 806_3 is coupled to a switching regulator including the diode D8_3, the switch S8_3 and the inductor L8_3.

The driving circuit 800 further includes multiple switch controllers 804_1, 804_2 and 804_3 operable for controlling the LED currents through the LED strings 806_1-806_3, respectively. For example, the switch controllers 804_1-804_3 respectively compare sense signals ISEN_1-ISEN_3 to a reference signal REF indicative of a desired current level, and generate switch control signals PWM_1-PWM_3 to adjust the LED currents to a predetermined current level. In other words, the switch controllers 804_1-804_3 can balance the currents through the LED strings 806_1-806_3, such that the LED strings provide uniform brightness.

The switch controllers 804_1-804_3 further generate error signals VEA_1, VEA_2 and VEA_3, each of which indicates a forward voltage needed by a corresponding LED string 806_1-806_3 to produce an LED current having the predetermined current level. The driving circuit 800 further includes a feedback selection circuit 812 which receives the error signals VEA_1-VEA_3 and determines which LED string has a maximum forward voltage among those of the LED strings 806_1-806_3. As a result, the feedback selection circuit 812 generates a feedback signal 810 indicating the LED current of the LED string having the maximum forward voltage. Consequently, the converter circuit 202 adjusts the output voltage $V_{OUT_H}$ according to the feedback signal 810 to satisfy a power need of the LED string having the maximum forward voltage, in one embodiment. Since the output voltage $V_{OUT_H}$ can satisfy the power need of the LED string having the maximum forward voltage, the power need of other LED strings can also be satisfied. The driving circuit 800 can have other configurations, for example, each LED string 806_1-806_3 can be driven by a circuit shown in FIG. 6 or FIG. 7.

Advantageously, the voltage ratings of the switch element associated with each LED string can be decreased due to the output voltage $V_{OUT_L}$ on the power line 242. Thus, the power consumption and the cost of the driving circuit 800 are reduced.

Figure 9:
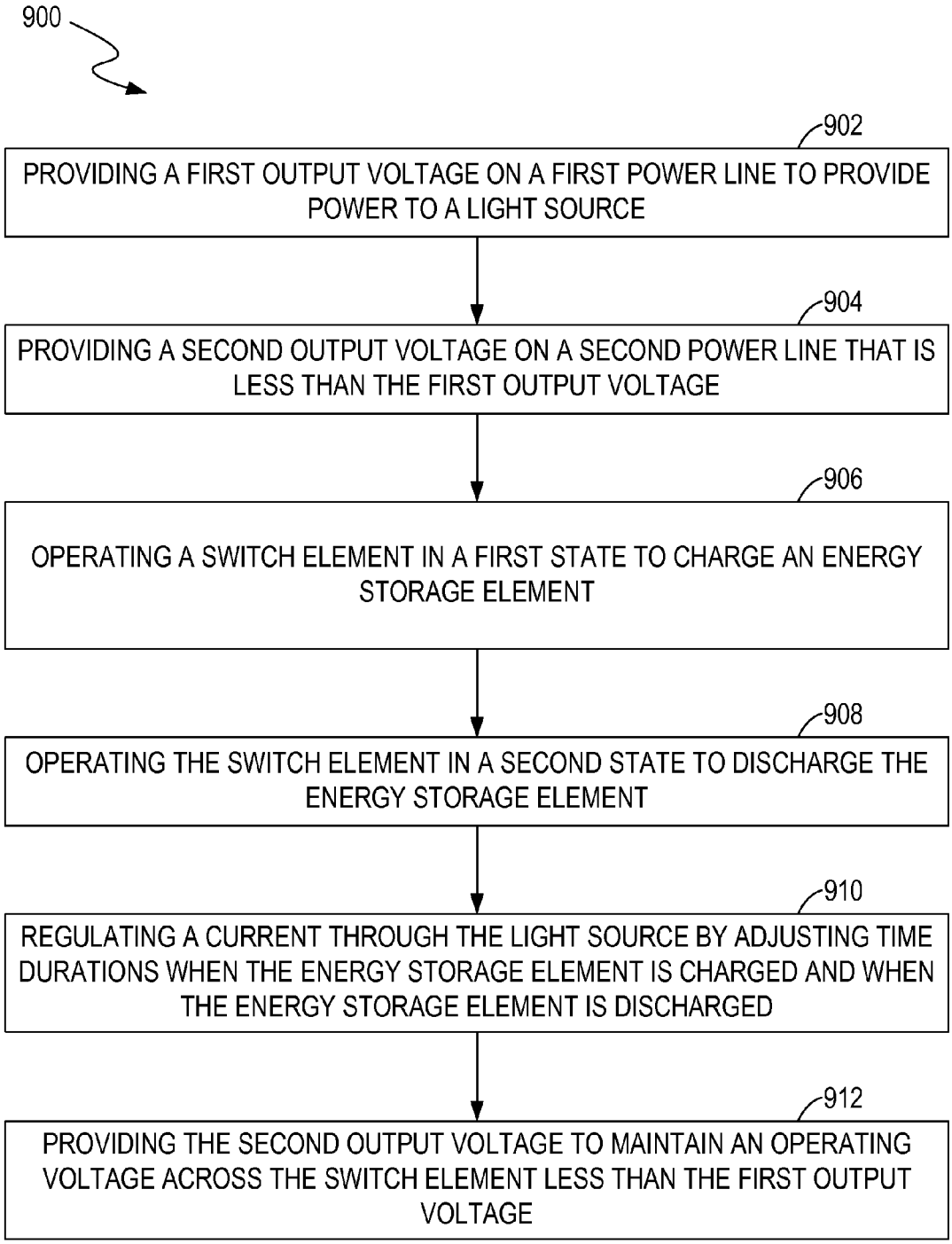
FIG. 9 illustrates a flowchart of operations performed by a driving circuit, in accordance with one embodiment of the present invention.

FIG. 9 illustrates a flowchart 900 of operations performed by a driving circuit, e.g., the driving circuit 200, in accordance with one embodiment of the present invention. FIG. 9 is described in combination with FIG. 2-FIG. 8. Although specific steps are disclosed in FIG. 9, such steps are examples. That is, the present invention is well suited to performing various other steps or variations of the steps recited in FIG. 9.

In block 902, a first output voltage, e.g., the voltage $V_{OUT_H}$, is provided on a first power line to provide power to a light source, e.g., the LED light source 206. In block 904, a second output voltage, e.g., the voltage $V_{OUT_L}$, that is less than the first output voltage is provided on a second power line.

In block 906, a switch element, e.g., the switch element 222, operates in a first state during which an energy storage element, e.g., the energy storage element 220, is charged. In block 908, the switch element operates in a second state during which the energy storage element is discharged. In block 910, a current through the light source is regulated by adjusting time durations when the energy storage element is charged and when the energy storage element is discharged. In one embodiment, the energy storage element includes an inductor. In one embodiment, the switch element includes a transistor and a diode.

In block 912, the second output voltage is provided to maintain an operating voltage across the switch element less than the first output voltage during both first state and second state. In one embodiment, a current of the energy storage element is conducted through the first power line and a reference node to charge the energy storage element. The current of the energy storage element is conducted through the first power line and the second power line to discharge the energy storage element. In yet another embodiment, the current of the energy storage element is conducted through the first power line and a reference node to charge the energy storage element. The current of the energy storage element is conducted through the second power line and the reference node to discharge the energy storage element. In yet another embodiment, the current of the energy storage element is conducted through the first power line and the second power line to charge the energy storage element. The current of the energy storage element is conducted through the first power line and a reference node to discharge the energy storage element.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A driving circuit for powering a light-emitting diode (LED) light source, said driving circuit comprising:

a converter circuit providing a first output voltage on a first power line to provide power to said LED light source and providing a second output voltage on a second power line that is less than said first output voltage;

an energy storage element being charged and discharged to regulate a current through said LED light source; and a switch element coupled to said converter circuit and said energy storage element, said switch element operating in a first state during which said energy storage element is charged and operating in a second state during which said energy storage element is discharged, wherein said converter circuit provides said second output voltage to maintain an operating voltage across said switch element less than said first output voltage during both said first state and said second state.

2. The driving circuit as claimed in claim 1, wherein said switch element conducts a current of said energy storage element through said first power line and a reference node during said first state, and conducts said current of said energy storage element through said first power line and said second power line during said second state.

3. The driving circuit as claimed in claim 1, wherein said switch element conducts a current of said energy storage element through said first power line and a reference node during said first state, and conducts said current of said energy storage element through said second power line and said reference node during said second state.

4. The driving circuit as claimed in claim 1, wherein said switch element conducts a current of said energy storage element through said first power line and said second power line during said first state, and conducts said current of said energy storage element through said first power line and a reference node during said second state.

5. The driving circuit as claimed in claim 1, further comprising:

a transformer having a primary winding and a secondary winding, wherein said primary winding receives said input voltage, and wherein said secondary winding provides said first output voltage at a first terminal of said secondary winding and provides said second output voltage at a second terminal of said secondary winding.

6. The driving circuit as claimed in claim 1, further comprising:

a transformer having a primary winding, a secondary winding and an auxiliary winding, wherein said secondary winding and said auxiliary winding are coupled to a common node, wherein said primary winding receives said input voltage, wherein said secondary winding provides said first output voltage at a first terminal of said secondary winding, and wherein said auxiliary winding provides said second output voltage at said common node.

7. The driving circuit as claimed in claim 1, wherein said storage element comprises an inductor, and wherein said switch element comprises a switch and a diode.

8. The driving circuit as claimed in claim 1, wherein said second output voltage varies in accordance with said first output voltage.

9. A driving circuit for powering a plurality of light-emitting diode (LED) light sources, said driving circuit comprising:

a converter circuit providing a first output voltage on a first power line to provide power to said plurality of LED light sources and providing a second output voltage on a second power line that is less than said first output voltage; and a plurality of switching regulators coupled to said converter circuit and adjusting a plurality of currents flowing through said plurality of LED light sources, wherein each of said switching regulators comprises a switch element, said switch element operating in a first state during which an energy storage element is charged and operating in a second state during which said energy storage element is discharged, wherein a current flowing through a corresponding LED light source is regulated by adjusting time durations when said energy storage element is charged and when said energy storage element is discharged, and wherein said converter circuit provides said second output voltage to maintain an operating voltage across said switch element less than said first output voltage during both said first and second states.

10. The driving circuit as claimed in claim 9, further comprising:

a plurality of switch controllers coupled to said plurality of switching regulators, said switch controllers receiving a plurality of sense signals indicating said plurality of currents flowing through said plurality of LED light sources respectively, comparing said sense signals to a reference signal indicating a desired current level, and generating a plurality of switch control signals according to results of said comparison, wherein said switching regulators receive said switch control signals and adjust each of said currents through said LED light sources to said desired current level.

11. The driving circuit as claimed in claim 9, wherein said switch element conducts a current of said energy storage element through said first power line and a reference node during said first state, and conducts said current of said energy storage element through said first power line and said second power line during said second state.

12. The driving circuit as claimed in claim 9, wherein said switch element conducts a current of said energy storage element through said first power line and a reference node during said first state, and conducts said current of said energy storage element through said second power line and said reference node during said second state.

13. The driving circuit as claimed in claim 9, wherein said switch element conducts a current of said energy storage element through said first power line and said second power line during said first state, and conducts said current of said energy storage element through said first power line and a reference node during said second state.

14. The driving circuit as claimed in claim 9, wherein said storage element comprises an inductor, and said switch element comprises a switch and a diode.

15. A method for powering a light-emitting diode (LED) light source, said method comprising:

providing a first output voltage on a first power line to provide power to said LED light source;

providing a second output voltage on a second power line that is less than said first output voltage;

operating a switch element in a first state to charge an energy storage element;

operating said switch element in a second state to discharge said energy storage element;

regulating a current through said LED light source by adjusting time durations when said switch element is in said first state and when said switch element is in said second state; and providing said second output voltage to maintain an operating voltage across said switch element less than said first output voltage during both said first state and said second state.

16. The method as claimed in claim 15, further comprising:

conducting a current of said energy storage element through said first power line and a reference node to charge said energy storage element; and conducting said current of said energy storage element through said first power line and said second power line to discharge said energy storage element.

17. The method as claimed in claim 15, further comprising:

conducting a current of said energy storage element through said first power line and a reference node to charge said energy storage element; and conducting said current of said energy storage element through said second power line and said reference node to discharge said energy storage element.

18. The method as claimed in claim 15, further comprising:

conducting a current of said energy storage element through said first power line and said second power line to charge said energy storage element; and conducting said current of said energy storage element through said first power line and a reference node to discharge said energy storage element.

19. The method as claimed in claim 15, wherein said energy storage element comprises an inductor.

20. The method as claimed in claim 15, wherein said switch element comprises a transistor and a diode.

* * * * *